US007584095B2

(12) United States Patent
Gottesman et al.

(10) Patent No.: US 7,584,095 B2
(45) **Date of Patent: *Sep. 1, 2009**

(54) REW PARAMETRIC VECTOR QUANTIZATION AND DUAL-PREDICTIVE SEW VECTOR QUANTIZATION FOR WAVEFORM INTERPOLATIVE CODING

(75) Inventors: Oded Gottesman, Goleta, CA (US); Allen Gersho, Goleta, CA (US)

(73) Assignee: The Regents of the University of California, Oakland, CA (US)

( * ) Notice: Subject to any disclaimer, the term of this patent is extended or adjusted under 35 U.S.C. 154(b) by 98 days.

This patent is subject to a terminal disclaimer.

(21) Appl. No.: 11/234,631

(22) Filed: Sep. 23, 2005

(65) Prior Publication Data

US 2006/0069554 A1 Mar. 30, 2006

Related U.S. Application Data

(62) Division of application No. 09/811,187, filed on Mar. 16, 2001, now Pat. No. 7,010,482.

(60) Provisional application No. 60/190,371, filed on Mar. 17, 2000.

(51) Int. Cl.
*G10L 19/14* (2006.01)

(52) U.S. Cl. ..... 704/222

(58) Field of Classification Search ..... 704/222
See application file for complete search history.

(56) References Cited

U.S. PATENT DOCUMENTS 5,924,061 A * 7/1999 Shoham ..... 704/218
6,418,408 B1 * 7/2002 Udaya Bhaskar et al. ... 704/219
6,493,664 B1 * 12/2002 Udaya Bhaskar et al. ... 704/222
6,691,092 B1 * 2/2004 Udaya Bhaskar et al. ... 704/265

OTHER PUBLICATIONS

Oded Gottesman et al., "Enhancing Waveform Interpolative Coding With Weighted REW Parametric Quantization," IEEE Workshop on Speech Coding (2000), pp. 1-3.

I.S. Burnett et al., "Multi-Prototype Waveform Coding Using Frame-By-Frame Analysis-By-Synthesis," Department of Eelctrical and Computer Engineering, University of Wollongong, NSW, Australia (1997), pp. 1567-1570.

I.S. Burnett et al., "New Techniques for Multi-Prototype Waveform Coding at 2.84kb/s," Department of Electrical and Computer Engineering, University of Wollongong, NSW, Australia (1995), pp. 261-264.

I.S. Burnett et al., "Low Complexity Decomposition and Coding of Prototype Waveforms," Dept. of Electrical and Computer Eng., University of Wollongong, NSW, 2522, Australia, pp. 23-24.

(Continued)

*Primary Examiner*—Susan McFadden
(74) *Attorney, Agent, or Firm*—Berliner & Associates

(57) ABSTRACT

An enhanced analysis-by-synthesis waveform interpolative speech coder able to operate at 2.8 kbps. Novel features include dual-predictive analysis-by-synthesis quantization of the slowly-evolving waveform, efficient parametrization of the rapidly-evolving waveform magnitude, and analysis-by-synthesis vector quantization of the rapidly evolving waveform parameter. Subjective quality tests indicate that it exceeds G.723.1 at 5.3 kbps, and of G.723.1 at 6.3 kbps.

18 Claims, 6 Drawing Sheets

OTHER PUBLICATIONS

I.S. Burnett et al., "A Mixed Prototype Waveform/CELP Coder for Sub 3KB/S," School of Elecronic and Electrical Engineering, University of Bath, U.K. BA2 7AY (1993), pp. II-175-II-178.

Oded Gottesman, "Dispersion Phase Vector Quantization for Enhancement of Waveform Interpolative Coder," Signal Compression Laboratory, Department of Electrical and Computer Engineering, University of California, Santa Barbara, Calilfornia 93106, USA, pp. 1-4.

Oded Gottesman et al., "Enhanced Waveform Interpolative Coding at 4 KBPS," Signal Compression Laboratory, Department of Electrical and Computer Engineering, University of California, Santa Barbara, California 93106, USA, pp. 1-3.

Oded Gottesman et al., "High Quality Enhanced Waveform Interpolative Coding at 2.8 KBPS," IEEE International Conference on Acoustics, Speech, and Signal Processing, 2000, pp. 1-4.

Oded Gottesman et al., "Enhanced Analysis-by-Synthesis Waveform Interpolative Coding at 4 KBPS," Signal Compression Laboratory, Department of Electrical and Computer Engineering, University of California, Santab Barbara, California 93106, USA, pp. 1-4.

Daniel W. Griffin et al., "Multiband Excitation Vocoder," IEEE Transactions on Acoustics, Speech, and Signal Processing (1988) 36(8):1223-1235.

W. Bastiaan Kleijn et al., "A Speech Coder Based on Decomposition of Characteristic Waveforms," IEEE (1995), p. 508-511.

W. Bastiaan Kleijn et al., "Waveform Interpolation for Coding and Synthesis," Speech Coding and Synthesis (1995), pp. 175-207.

W. Bastiaan Kleijn et al., "Transformation and Decomposition of the Speech Signal for Coding," IEEE Signal Procesing Letters 1(9):136-138 (1994).

W. Bastiaan Kleijn, "Encoding Speech Using Prototype Waveforms," IEE Transactions on Speech and Audio Processing 1(4):386-399 (1993).

W. Bastiaan Kleijn, "Continuous Representations in Linear Predictive Coding," Speech Research Department, AT&T Bell Laboratories, Murray Hill, NJ 07974 (1991), pp. 201-204.

W. Bastiaan Kleijn et al., "A Low-Complexity Waveform Interpolation Coder," Speech Coding Research Department, AT&T Bell Laboratories, 600 Mountain Avenue, Murray Hill, NJ 07974, USA (1996), pp. 212-215.

R.J. McAulay et al., "Sinusoidal Coding," Speech Coding and Synthesis 4:121-173 (1995).

Yair Shoham, "High-Quality Speech Coding at 2.4 to 4.0 KBPS Based on Time-Frequency Interpolation," IEEE, pp. II-167-II-170 (1993).

Yair Shoham, "Very Low Complexity Interpolative Speech Coding at 1.2 to 2.4 KBPS," IEEE, pp. 1599-1602 (1997).

Yair Shoham, "Low Complexity Speech Coding at 1.2 to 2.4 kbps Based on Waveform Interpolation," International Journal of Speech Technology 2:329-341 (1999).

* cited by examiner

REW PARAMETRIC VECTOR QUANTIZATION AND DUAL-PREDICTIVE SEW VECTOR QUANTIZATION FOR WAVEFORM INTERPOLATIVE CODING

CROSS REFERENCE TO RELATED APPLICATION

This application claims the benefit of Provisional Patent Application No. 60/190,371 filed Mar. 17, 2000, which application is herein incorporated by reference. This application is a divisional of U.S. patent application Ser. No. 09/811,187, filed Mar. 16, 2001 now U.S. Pat. No. 7,010,482.

BACKGROUND OF THE INVENTION

The present invention relates to vector quantization (VQ) in speech coding systems using waveform interpolation.

In recent years, there has been increasing interest in achieving toll-quality speech coding at rates of 4 kbps and below. Currently, there is an ongoing 4 kbps standardization effort conducted by an international standards body (The International Telecommunications Union-Telecommunication (ITU-T) Standardization Sector). The expanding variety of emerging applications for speech coding, such as third generation wireless networks and Low Earth Orbit (LEO) systems, is motivating increased research efforts. The speech quality produced by waveform coders such as code-excited linear prediction (CELP) coders degrades rapidly at rates below 5 kbps; see B. S. Atal, and M. R. Schroeder, (1984) "Stochastic Coding of Speech at Very Low Bit Rate", *Proc. Int. Conf. Comm, Amsterdam*, pp. 1610-1613.

On the other hand, parametric coders, such as: the waveform-interpolative (WI) coder, the sinusoidal-transform coder (STC), and the multiband-excitation (MBE) coder, produce good quality at low rates but they do not achieve toll quality; see Y. Shoham, *IEEE ICASSP'93*, Vol. II, pp. 167-170 (1993); I. S. Burnett, and R. J. Holbeche, (1993), *IEEE ICASSP'93*, Vol. II, pp. 175-178; W. B. Kleijn, (1993), *IEEE Trans. Speech and Audio Processing*, Vol. 1, No. 4, pp. 386-399; W. B. Kleijn, and J. Haagen, (1994), *IEEE Signal Processing Letters*, Vol. 1, No. 9, pp. 136-138; W. B. Kleijn, and J. Haagen, (1995), *IEEE ICASSP'95*, pp. 508-511; W. B. Kleijn, and J. Haagen, (1995), in *Speech Coding Synthesis* by W. B. Kleijn and K. K. Paliwal, *Elsevier Science* B. V., Chapter 5, pp. 175-207; I. S. Burnett, and G. J. Bradley, (1995), *IEEE ICASSP'95*, pp. 261-263, 1995; I. S. Burnett, and G. J. Bradley, (1995), *IEEE Workshop on Speech Coding for Telecommunications*, pp. 23-24; I. S. Burnett, and D. H. Pham, (1997), *IEEE ICASSP'97*, pp. 1567-1570; W. B. Kleijn, Y. Shoham, D. Sen, and R. Haagen, (1996), *IEEE ICASSP'96*, pp. 212-215; Y. Shoham, (1997), *IEEE ICASSP'97*, pp. 1599-1602; Y. Shoham, (1999), *International Journal of Speech Technology, Kluwer Academic Publishers*, pp. 329-341; R. J. McAulay, and T. F. Quatieri, (1995), in *Speech Coding Synthesis* by W. B. Kleijn and K. K. Paliwal, *Elsevier Science* B. V., Chapter 4, pp. 121-173; and D. Griffin, and J. S. Lim, (1988), *IEEE Trans. ASSP*, Vol. 36, No. 8, pp. 1223-1235. This is largely due to the lack of robustness of speech parameter estimation, which is commonly done in open-loop, and to inadequate modeling of non-stationary speech segments.

Commonly in WI coding, the similarity between successive rapidly evolving waveform (REW) magnitudes is exploited by downsampling and interpolation and by constrained bit allocation; see W. B. Kleijn, and J. Haagen, (1995), *IEEE ICASSP'95*, pp. 508-511. In a previous Enhanced Waveform Interpolative (EWI) coder the REW magnitude was quantized on a waveform by waveform base; see O. Gottesman and A. Gersho, (1999), "Enhanced Waveform Interpolative Coding at 4 kbps", *IEEE Speech Coding Workshop*, pp. 90-92, Finland; Finland. O. Gottesman and A. Gersho, (1999), "Enhanced Analysis-by-Synthesis Waveform Interpolative Coding at 4 kbps", EUROSPEECH'99, pp. 1443-1446, Hungary.

SUMMARY OF THE INVENTION

The present invention describes novel methods that enhance the performance of the WI coder, and allows for better coding efficiency improving on the above 1999 Gottesman and Gersho procedure. The present invention incorporates analysis-by-synthesis (AbS) for parameter estimation, offers higher temporal and spectral resolution for the REW, and more efficient quantization of the slowly-evolving waveform (SEW). In particular, the present invention proposes a novel efficient parametric representation of the REW magnitude, an efficient paradigm for AbS predictive VQ of the REW parameter sequence, and dual-predictive AbS quantization of the SEW.

More particularly, the invention provides a method for interpolative coding input signals, the signals decomposed into or composed of a slowly evolving waveform and a rapidly evolving waveform having a magnitude, the method incorporating at least one various, preferably combinations of the following steps or can include all of the steps:

(a) AbS VQ of the REW;

(b) parametrizing the magnitude of the REW;

(c) incorporating temporal weighting in the AbS VQ of the REW;

(d) incorporating spectral weighting in the AbS VQ of the REW;

(e) applying a filter to a vector quantizer codebook in the analysis-by-synthesis vector-quantization of the rapidly evolving waveform whereby to add self correlation to the codebook vectors; and (f) using a coder in which a plurality of bits therein are allocated to the rapidly evolving waveform magnitude.

In addition, one can combine AbS quantization of the slowly evolving waveform with any or all of the foregoing parameters.

The new method achieves a substantial reduction in the REW bit rate and the EWI achieves very close to toll quality, at least under clean speech conditions. These and other features, aspects, and advantages of the present invention will become better understood with regard to the following detailed description, appended claims, and accompanying drawings.

DETAILED DESCRIPTION

Figure 1:
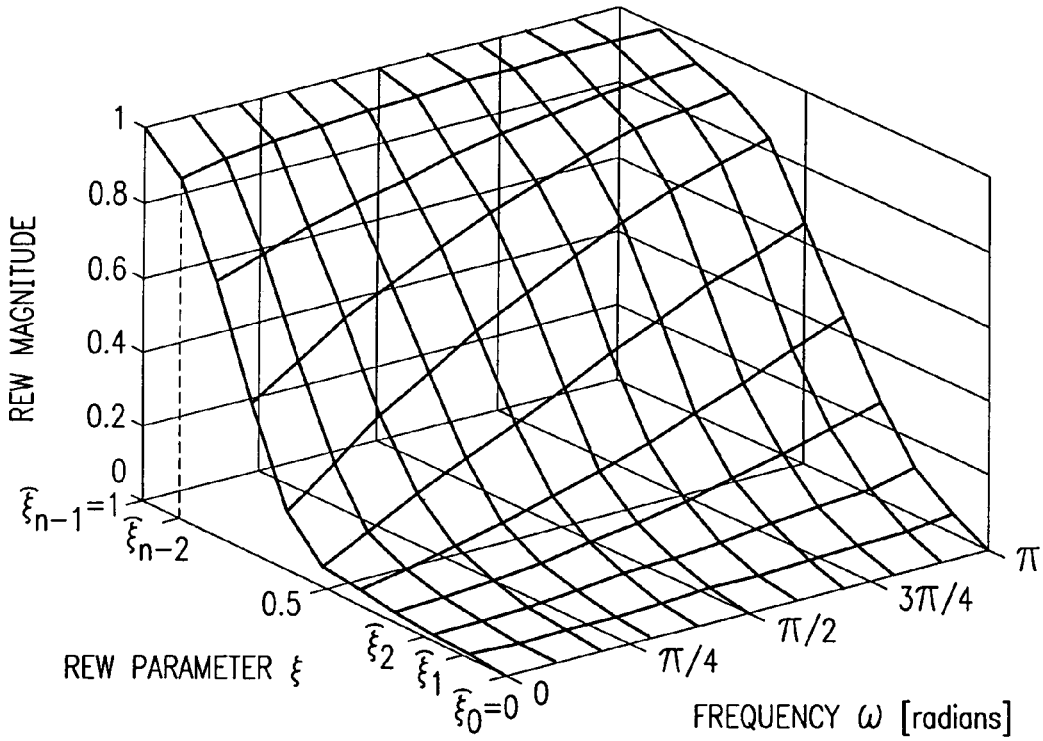
FIG. 1 is a REW Parametric Representation.

In very low bit rate WI coding, the relation between the SEW and the REW magnitudes was exploited by computing the magnitude of one as the unity complement of the other; see W. B. Kleijn, and J. Haagen, (1995), "A Speech Coder Based on Decomposition of Characteristic Waveforms", IEEE ICASSP'95, pp. 508-511; W. B. Kleijn, and J. Haagen, (1995), "Waveform Interpolation for Coding and Synthesis", in *Speech Coding Synthesis* by W B. Kleijn and K. K. Paliwal, Elsevier Science B. V., Chapter 5, pp. 175-207; I. S. Burnett, and G. J. Bradley, (1995), "New Techniques for Multi-Prototype Waveform Coding at 2.84 kb/s", *IEEE ICASSP'95*, pp. 261-263, 1995; I. S. Burnett, and G. J. Bradley, (1995), "Low Complexity Decomposition and Coding of Prototype Waveforms", *IEEE Workshop on Speech Coding for Telecommunications*, pp. 23-24; I. S. Burnett, and D. H. Pham, (1997), "Multi-Prototype Waveform Coding using Frame-by-Frame Analysis-by-Synthesis", *IEEE ICASSP'97*, pp. 1567-1570; W. B. Kleijn, Y. Shoham, D. Sen, and R. Haagen, (1996), "A Low-Complexity Waveform Interpolation Coder", *IEEE ICASSP'96*, pp. 212-215; Y. Shoham, (1997), "Very Low Complexity Interpolative Speech Coding at 1.2 to 2.4 kbps", *IEEE ICASSP'97*, pp. 1599-1602; Y. Shoham, (1999), "Low-Complexity Speech Coding at 1.2 to 2.4 kbps Based on Waveform Interpolation", *International Journal of Speech Technology*, Kluwer Academic Publishers, pp. 329-341.

Also, since the sequence of SEW magnitude evolves slowly, successive SEWs exhibit similarity, offering opportunities for redundancy removal. Additional forms of redundancy that may be exploited for coding efficiency are: (a) for a fixed SEW/REW decomposition filter, the mean SEW magnitude increases with the pitch period and (b) the similarity between successive SEWs, also increases with the pitch period. In this work we introduce a novel "dual-predictive" AbS paradigm for quantizing the SEW magnitude that optimally exploits the information about the current quantized REW, the past quantized SEW, and the pitch, in order to predict the current SEW.

Introduction to REW Quantization

The REW represents the rapidly changing unvoiced attribute of speech. Commonly in WI systems, the REW is quantized on a waveform by waveform base. Hence, for low rate WI systems having long frame size, and a large number of waveforms per frame, the relative bitrate required for the REW becomes significantly excessive. For example, consider a potential 2 kbps system which uses a 240 sample frame, 12 waveforms per frame, and which quantizes the SEW by alternating bit allocation of 3 bit and 1 bit per waveform. The REW bitrate is then 24 bit per frame, or 800 kbps which is 40% of the total bitrate. This example demonstrates the need for a more efficient REW quantization.

Efficient REW quantization can benefit from two observations: (1) the REW magnitude is typically an increasing function of the frequency, which suggests that an efficient parametric representation may be used; (2) one can observe a similarity between successive REW magnitude spectra, which may suggest a potential gain by employing predictive VQ on a group of adjacent REWs. The next two sections propose REW parametric representation, and its respective VQ.

REW Parametric Representation

Direct quantization of the REW magnitude is a variable dimension quantization problem, which may result in spending bits and computational effort on perceptually irrelevant information. A simple and practical way to obtain a reduced, and fixed, dimension representation of the REW is with a linear combination of basis functions, such as orthonormal polynomials; see W. B. Kleijn, Y. Shoham, D. Sen, and R. Haagen, (1996), *IEEE ICASSP'96*, pp. 212-215; Y. Shoham, (1997), *IEEE ICASSP'97*, pp. 1599-1602; Y. Shoham, (1999), *International Journal of Speech Technology*, Kluwer Academic Publishers, pp. 329-341. Such a representation usually produces a smoother REW magnitude, and improves the perceptual quality. Suppose the REW magnitude, $R(\omega)$, is represented by a linear combination of orthonormal functions, $\psi_i(\omega)$:

$$R(\omega) = \sum_{i=0}^{I-1} \gamma_i \psi_i(\omega),\ 0 \le \omega \le \pi \tag{1}$$

where $\omega$ is the angular frequency, and I is the representation order. The REW magnitude is typically an increasing function of frequency, which, can be coarsely quantized with a low number of bits per waveform without significant perceptual degradation. Therefore, it may be advantageous to represent the REW magnitude in a simple, but perceptually relevant manner. Consequently we model the REW by the following parametric representation, $\hat{R}(\omega,\xi)$:

$$\hat{R}(\omega, \xi) = \sum_{i=0}^{I-1} \hat{\gamma}_i(\xi)\psi_i(\omega),\ 0 \le \omega \le \pi;\ 0 \le \xi \le 1 \tag{2}$$

where $\hat{\gamma}(\xi)=[\hat{\gamma}_0(\xi), \ldots, \hat{\gamma}_{I-1}(\xi)]^T$ is a parametric vector of coefficients within the representation model subspace, and $\xi$ is the "unvoicing" parameter which is zero for a fully voiced spectrum, and one for a fully unvoiced spectrum. Thus $\hat{R}(\omega,\xi)$ defines a two-dimensional surface whose cross sections for each value of $\xi$ give a particular REW magnitude spectrum, which is defined merely by specifying a scalar parameter value.

A simple and practical way for parametric representation of the REW is, for example, by a parametric linear combination of basis functions, such as polynomials with parametric coefficients, namely:

$$\hat{R}(\omega, \xi) = \sum_{i=0}^{I-1} \hat{\gamma}_i(\xi)\omega^i,\ 0 \le \omega \le \pi;\ 0 \le \xi \le 1 \tag{3}$$

For practical considerations assume that the parametric representation is a piecewise linear function of $\xi$, and may therefore be represented by a set of N uniformly spaced spectra, as illustrated in FIG. 1.

REW Parametric Vector Quantization

Figure 2:
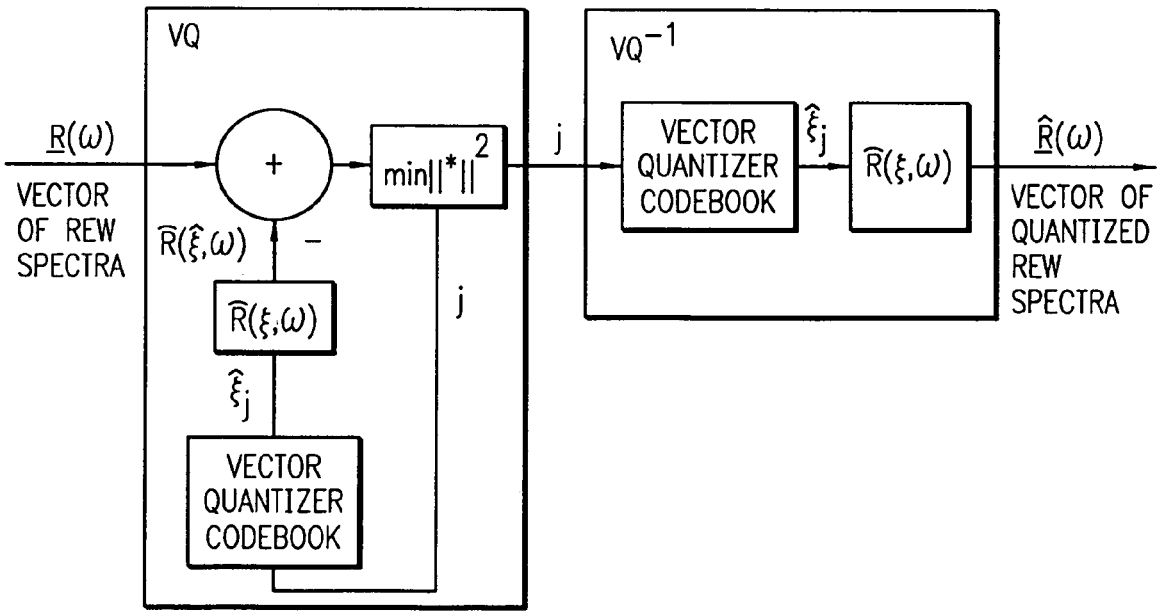
FIG. 2 is a REW Parametric VQ.

One can observe the similarity between successive REW magnitude spectra, which may suggest a potential gain by VQ of a set of successive REWs. FIG. 2 illustrates a simple parametric VQ system for a vector of REW spectra. The input is an M dimensional vector of REW magnitude spectra, $$\underline{R}(\omega)=[R_1(\omega), R_2(\omega), \ldots, R_M(\omega)]^T \tag{4}$$

and the VQ output is an index, j, which determines a quantized parameter vector, $\hat{\xi}$:

$$\hat{\xi}=[\hat{\xi}_1,\hat{\xi}_2,\ldots,\hat{\xi}_M]^T \tag{5}$$

which parametrically determines a vector of quantized spectra:

$$\hat{\underline{R}}(\omega)=\hat{\underline{R}}(\omega,\hat{\xi})=[\hat{R}(\omega,\hat{\xi}_1),\hat{R}(\omega,\hat{\xi}_2),\ldots,\hat{R}(\omega,\hat{\xi}_M)]^T \tag{6}$$

The encoder searches, in the parameter codebook $C_q(\xi)$, for the parameter vector which minimizes the distortion:

$$\hat{\xi}=\underset{\xi\in C_q(\xi)}{\operatorname{argmin}}\left\{\sum_{m=1}^{M} D\left(R_m,\hat{R}(\xi_m)\right)\right\}=\underset{\xi\in C_q(\xi)}{\operatorname{argmin}}\left\{\sum_{m=1}^{M}\int_0^{\pi}\left|R_m(\omega)-\hat{R}(\omega,\xi_m)\right|^2 d\omega\right\} \tag{7}$$

For example, suppose the input REW magnitude is represented by an I-th dimensional vector of function coefficients, $\gamma$, given by:

$$\gamma=[\gamma_0,\gamma_1,\ldots,\gamma_{I-1}]^T \tag{8}$$

For a set of M input REWs, each is of which represented by a vector of polynomial coefficients, $\gamma_m$, which form a P×M input coefficient matrix, $\Gamma$:

$$\Gamma=[\gamma_1,\gamma_2,\ldots,\gamma_M] \tag{9}$$

The inverse VQ output is a vector of M quantized REWs, which form the quantized function coefficient matrix:

$$\hat{\Gamma}(\hat{\xi})=[\hat{\gamma}(\hat{\xi}_1),\hat{\gamma}(\hat{\xi}_2),\ldots,\hat{\gamma}(\hat{\xi}_M)] \tag{10}$$

which is used by the decoder to compute the quantized spectra.

A. Quantization Using Orthonormal Functions

Orthonormal functions, such as polynomials, may be used for efficient quantization of the REW; see W. B. Kleijn, et al., (1996), *IEEE ICASSP'96*, pp. 212-215; Y. Shoham, (1997), *IEEE ICASSP'97*, pp. 1599-1602; Y. Shoham, (1999), *International Journal of Speech Technology*, Kluwer Academic Publishers, pp. 329-341. Consider REW magnitude, $R(\omega)$, represented by a linear combination of orthonormal functions, $\psi_i(\omega)$:

$$R(\omega)=\sum_{i=0}^{I-1}\gamma_i\psi_i(\omega),\ 0\le\omega\le\pi \tag{11}$$

which is modeled using the parametric representation:

$$\hat{R}(\omega,\xi)=\sum_{i=0}^{I-1}\bar{\gamma}_i(\xi)\psi_i(\omega),\ 0\le\omega\le\pi;\ 0\le\xi\le 1 \tag{12}$$

The quantized REW parameter is then given by:

$$\hat{\xi}=\underset{\xi\in C_q(\xi)}{\operatorname{argmin}}\left\{\int_0^{\pi}\left|R(\omega)-\hat{R}(\omega,\xi)\right|^2 d\omega\right\}=\underset{\xi\in C_q(\xi)}{\operatorname{argmin}}\left\{\sum_{i=0}^{I-1}\left(\gamma_i-\bar{\gamma}_i,(\xi)\right)^2\right\} \tag{13}$$

In VQ case, the quantized parameter vector is given by:

$$\hat{\xi}=\underset{\xi\in C_q(\xi)}{\operatorname{argmin}}\left\{\sum_{m=1}^{M} D\left(R_m,\hat{R}(\xi_m)\right)\right\}=\underset{\xi\in C_q(\xi)}{\operatorname{argmin}}\left\{\sum_{m=1}^{M}\left\|\gamma_m-\bar{\gamma}(\xi_m)\right\|^2\right\} \tag{14}$$

B. Piecewise Linear Parametric Representation

In order to have a simple representation that is computationally efficient and avoids excessive memory requirements, we model the two dimensional surface by a piecewise linear parametric representation. Therefore, we introduce a set of N uniformly spaced spectra, $\{\hat{R}(\omega,\hat{\xi}_n)\}_{n=0}^{N-1}$. Then the parametric surface is defined by linear interpolation according t:

$$\hat{R}(\omega,\xi)=(1-\alpha)\hat{R}\left(\omega,\hat{\xi}_{n-1}\right)+\alpha\hat{R}\left(\omega,\hat{\xi}_n\right);\quad \hat{\xi}_{n-1}\le\xi\le\hat{\xi}_n;\ \alpha=\frac{\xi-\hat{\xi}_{n-1}}{\Delta};\ \Delta=\hat{\xi}_n-\hat{\xi}_{n-1} \tag{15}$$

Because this representation is linear, the coefficients of $\hat{R}(\omega,\xi)$ are linear combinations of the coefficients of $\hat{R}(\omega,\hat{\xi}_{n-1})$ and $\hat{R}(\omega,\hat{\xi}_n)$ Hence, $$\hat{\gamma}(\xi)=(1-\alpha)\hat{\gamma}_{n-1}+\alpha\hat{\gamma}_n \tag{16}$$

where $\hat{\gamma}_n$ is the coefficient vector of the n-th REW magnitude function representation:

$$\hat{\gamma}_n=\hat{\gamma}(\hat{\xi}_n) \tag{17}$$

In this case, the distortion may be interpolated by:

$$D\left(R,\hat{R}(\xi)\right)=\int_0^{\pi}\left|R(\omega)-(1-\alpha)\hat{R}\left(\omega,\hat{\xi}_{n-1}\right)-\alpha\hat{R}\left(\omega,\hat{\xi}_n\right)\right|^2 d\omega=\left\|\gamma-(1-\alpha)\bar{\gamma}_{n-1}-\alpha\bar{\gamma}_n\right\|^2 \tag{18}$$

The above can be easily generalized to the parameter VQ case. The optimal interpolation factor that minimizes the distortion between two representation vectors is given by:

$$\alpha_{opt}=\frac{\left(\bar{\gamma}_n-\bar{\gamma}_{n-1}\right)^T\left(\gamma-\bar{\gamma}_{n-1}\right)}{\left\|\bar{\gamma}_n-\bar{\gamma}_{n-1}\right\|^2} \tag{19}$$

and the respective optimal parameter value, which is a continuous variable between zero and one, is given by:

$$\xi(\gamma)=(1-\alpha_{opt})\hat{\xi}_{n-1}+\alpha_{opt}\hat{\xi}_n \tag{20}$$

This result allows a rapid search for the best unvoicing parameter value needed to transform the coefficient vector to a scalar parameter, followed by the corresponding quantization scheme, as described in the section 4.

C. Weighted Distortion Quantization

Commonly in speech coding, the magnitude is quantized using weighted distortion measure. In this case the quantized REW parameter is then given by:

$$\hat{\xi} = \underset{\xi \in C_q(\xi)}{\operatorname{argmin}} \left\{ \int_0^{\pi} \left| R(\omega) - \hat{R}(\omega, \xi) \right|^2 W(\omega)\, d\omega \right\} \tag{21}$$

and the orthonormal function simplification, given in equation (13), cannot be used. In this case, the weighted distortion between the input and the parametric representation modeled spectra is equal to:

$$D_w\left(R, \hat{R}(\xi)\right) = \int_0^{\pi} \left| R(\omega) - \hat{R}(\omega, \xi) \right|^2 W(\omega)\, d\omega = \left(\gamma - \hat{\gamma}(\xi)\right)^T \Psi(W(\omega)) \left(\gamma - \hat{\gamma}(\xi)\right) \tag{22}$$

where $\Psi(W(\omega))$ is the weighted correlation matrix of the orthonormal functions, its elements are:

$$\Psi_{i,j}(W(\omega)) = \int_0^{\pi} W(\omega)\psi_i(\omega)\psi_j(\omega)\, d\omega, \tag{23}$$

$\gamma$ is the input coefficient vectors, and $\hat{\gamma}(\xi)$ is the modeled parametric coefficient vector. In VQ case, the quantized parameter vector is given by:

$$\hat{\xi} = \underset{\xi \in C_q(\xi)}{\operatorname{argmin}} \left\{ \sum_{m=1}^{M} D_w\left(R_m, \hat{R}(\xi_m)\right) \right\} = \underset{\xi \in C_q(\xi)}{\operatorname{argmin}} \left\{ \sum_{m=1}^{M} \left(\gamma_m - \hat{\gamma}(\xi_m)\right)^T \Psi(W_m(\omega)) \left(\gamma_m - \hat{\gamma}(\xi_m)\right) \right\} \tag{24}$$

D. Weighted Distortion—Piecewise Linear Parametric Representation

Again, for practical considerations assume that the parametric representation is piecewise linear, and may be represented by a set of N spectra, $\{\hat{R}(\omega, \hat{\xi}_n)\}_{n=0}^{N-1}$. For the piecewise linear representation, the interpolated quantized coefficient vector is:

$$\hat{\gamma}(\xi) = (1-\alpha)\hat{\gamma}_{n-1} + \alpha\hat{\gamma}_n;\ \hat{\xi}_{n-1} \le \xi \le \hat{\xi}_n;\ \alpha = \frac{\xi - \hat{\xi}_{n-1}}{\hat{\xi}_n - \hat{\xi}_{n-1}} \tag{25}$$

In the case where parameter VQ is employed, the interpolation allows for a substantial simplification of the search computations. In this case, the distortion can be interpolated:

$$\begin{aligned} D_w(R, \hat{R}(\xi)) &= (\gamma - (1-\alpha)\hat{\gamma}_{n-1} - \alpha\hat{\gamma}_n)^T \Psi(W(\omega))(\gamma - (1-\alpha)\hat{\gamma}_{n-1} - \alpha\hat{\gamma}_n) = \gamma^T\Psi\gamma + (1-\alpha)^2\hat{\gamma}_{n-1}^T\Psi\hat{\gamma}_{n-1} + \alpha\hat{\gamma}_n^T\Psi\hat{\gamma}_n \\ &\quad - 2(1-\alpha)\gamma^T\Psi\hat{\gamma}_{n-1} - 2\alpha\gamma^T\Psi\hat{\gamma}_n + 2\alpha(1-\alpha)\hat{\gamma}_{n-1}\Psi\hat{\gamma}_n \end{aligned} \tag{26}$$

Note that no benefit is obtained here by using orthonormal functions, therefore any function representation may be used. The above can be easily generalized to the parameter VQ case. The optimal parameter that minimizes the spectrally weighted distortion between two representation vectors is given by:

$$\alpha_{opt} = \frac{\left(\hat{\gamma}_n - \hat{\gamma}_{n-1}\right)^T \Psi\left(\gamma - \hat{\gamma}_{n-1}\right)}{\left(\hat{\gamma}_n - \hat{\gamma}_{n-1}\right)^T \Psi\left(\hat{\gamma}_n - \hat{\gamma}_{n-1}\right)} \tag{27}$$

and the respective optimal parameter value, which is a continuous variable between zero and one, is given by equation (20). This result allows a rapid search for the best unvoicing parameter value needed to transform the coefficient vector to a scalar parameter, for encoding or for VQ design. Alternatively, in order to eliminate using the matrix $\psi$, the scalar product may redefined to incorporate the time-varying spectral weighting. The respective orthonormal basis functions then satisfy:

$$\int_0^{\pi} W(\omega)\psi_i(\omega)\psi_j(\omega)\, d\omega = \delta(i-j) \tag{28}$$

where $\delta(i-j)$ denotes Kroneker delta. The respective parameter vector is given by:

$$\gamma = \int_0^{\pi} W(\omega)R(\omega)\psi(\omega)\, d\omega \tag{29}$$

where $\psi(\omega) = [\psi_0, \psi_1, \ldots, \psi_{I-1}]^T$ is an I-th dimensional vector of time-varying orthonormal functions.

REW Parameter Analysis-By-Synthesis VQ

This section presents the AbS VQ paradigm for the REW parameter. The first presentation is a system which quantizes the REW parameter by employing spectral based AbS. Then simplified systems, which apply AbS to the REW parameter, are presented.

A. REW Parameter Quantization by Magnitude AbS VQ

Figure 3:
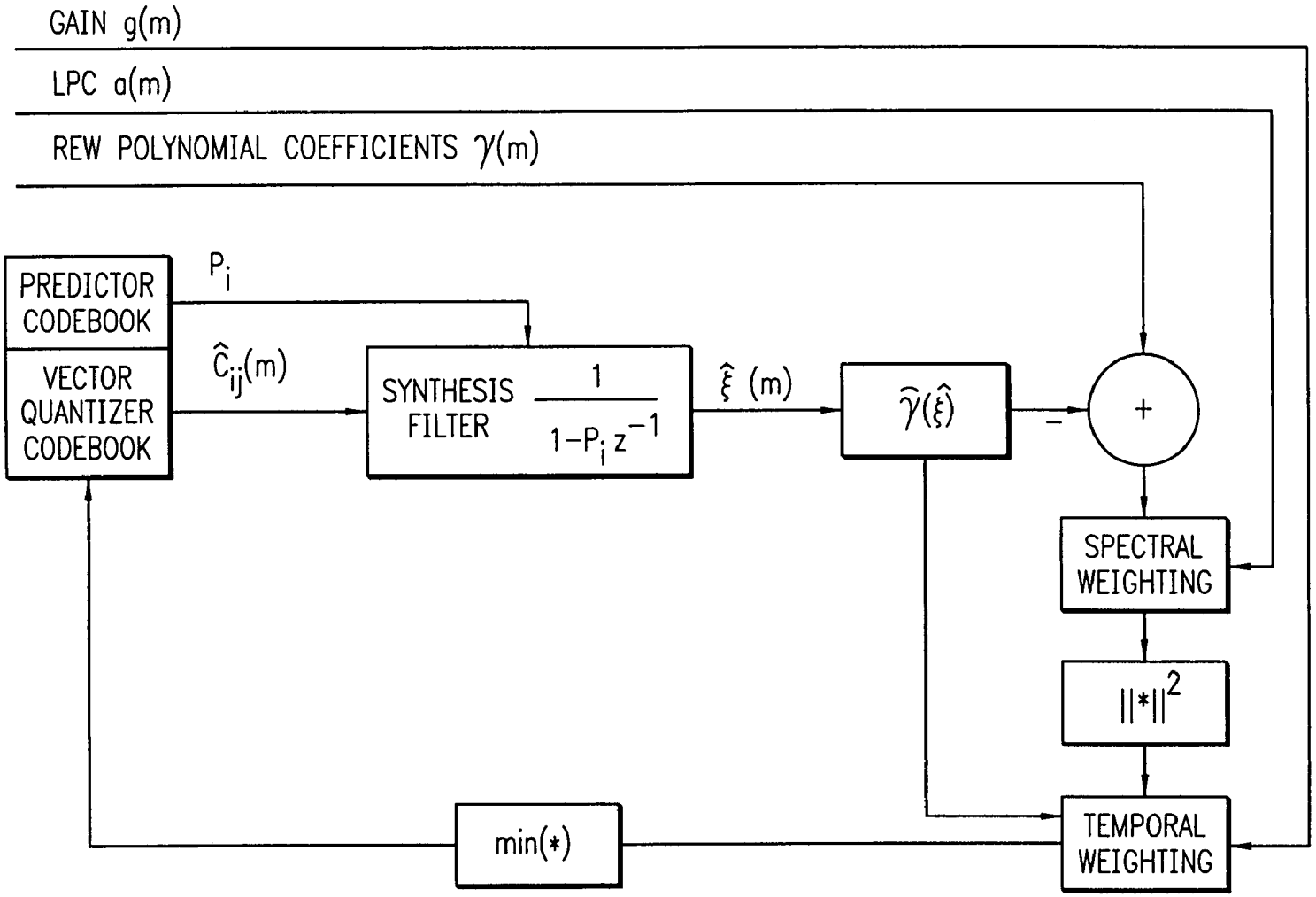
FIG. 3 is a REW Parametric Representation AbS VQ.

The novel Analysis-by-Synthesis (AbS) REW parameter VQ technique is illustrated in FIG. 3. An excitation vector $\hat{c}_{ij}(m)$ (m=1; . . . ,M) is selected from the VQ codebook and is fed through a synthesis filter to obtain a parameter vector $\hat{\xi}(m)$ (synthesized quantized) which is then mapped to quantized a representation coefficient vectors $\hat{\gamma}(\hat{\xi}(m))$. This is compared with a sequence of input representation coefficient vectors $\gamma(m)$ and each is spectrally weighted. Each spectrally weighted error is then temporally weighted, and a distortion measure is obtained. A search through all candidate excitation vectors determines an optimal choice. The synthesis filter in FIG. 3 can be viewed as a first order predictor in a feedback loop. (While shown here is an auto-regressive synthesis filter, in other arrangements moving-average (MA) synthesis filter may be used.) By allowing the value of the predictor parameter P to change, it becomes a "switched-predictor" scheme. Switched-prediction is introduced to allow for different levels of REW parameter correlation.

The scheme incorporates both spectral weighting and temporal weighting. The spectral weighting is used for the distortion between each pair of input and the quantized spectra. In order to improve SEW/REW mixing, particularly in mixed voiced and unvoiced speech segments, and to increase speech crispness, especially for plosives and onsets, temporal weighting is incorporated in the AbS REW VQ. The temporal weighting is a monotonic function of the temporal gain. Two codebooks are used, and each codebook has an associated predictor coefficient, $P_1$ and $P_2$. The quantization target is an M-dimensional vector of REW spectra. Each REW spectrum is represented by a vector of basis function coefficients denoted by $\gamma(m)$. The search for the minimal WMSE is performed over all the vectors, $\hat{c}_{ij}(m)$, of the two codebooks for i=1, 2. The quantized REW function coefficients vector, $\hat{\gamma}(\hat{\xi}(m))$, is a function of the quantized parameter $\hat{\xi}(m)$, which is obtained by passing the quantized vector, $\hat{c}_{ij}(m)$, through the synthesis filter. The weighted distortion between each pair of input and quantized REW spectra is calculated. The total distortion is a temporally-weighted sum of the M spectrally weighted distortions. Since the predictor coefficients are known, direct VQ can be used to simplify the computations. For a piecewise linear parametric REW representation, a substantial simplification of the search computations may be obtained by interpolating the distortion between the representation spectra set, as explained in sections 3.B. and 3.D.

A sequence of quantized parameter, such as $\hat{c}(k)$, is formed by concatenating successive quantized vectors, such as $\{\hat{c}_{ij}(m)\}_{m=1}^{M}$. The quantized parameter is computed recursively by:

$$\hat{\xi}(k)=P(k)\hat{\xi}(k-1)+\hat{c}(k) \tag{30}$$

where k is the time index of the coded waveform.

B. Simplified REW Parameter AbS VQ

The above scheme maps each quantized parameter to coefficient vector, which is used to compute the spectral distortion. To reduce complexity, such mapping, and spectral distortion computation, which contribute to the complexity of the scheme, may be eliminated by using the simplified scheme described below. For a high rate, and a smooth representation surface $\hat{R}(\omega,\xi)$, the total distortion is equal to the sum of modeling distortion and quantization distortion:

$$\sum_{m=1}^{M} D_w\left(R(m),\ \hat{R}(\xi(m))\right) = \sum_{m=1}^{M} D_w\left(R(m),\ \tilde{R}(\xi(m))\right) + \sum_{m=1}^{M} D_w\left(\tilde{R}(\xi(m)),\ \hat{R}(\hat{\xi}(m))\right) \tag{31}$$

The quantization distortion is related to the quantized parameter by:

$$\sum_{m=1}^{M} D_w\left(\tilde{R}(\xi(m)),\ \hat{R}(\hat{\xi}(m))\right) = \sum_{m=1}^{M} \left(\tilde{\gamma}(\xi(m)) - \hat{\gamma}(\hat{\xi}(m))\right)^T \Psi(W(m))\left(\tilde{\gamma}(\xi(m)) - \hat{\gamma}(\hat{\xi}(m))\right) \tag{32}$$

which, for the piecewise linear representation case, is equal to $$\sum_{m=1}^{M} D_w\left(\tilde{R}(\xi(m)),\ \hat{R}(\hat{\xi}(m))\right) = \frac{1}{\Delta^2}\sum_{m=1}^{M} \left(\tilde{\gamma}_n(\xi(m)) - \tilde{\gamma}_{n-1}(\xi(m))\right)^T \Psi(W(m))\left(\tilde{\gamma}_n(\xi(m)) - \tilde{\gamma}_{n-1}(\xi(m))\right)\left(\xi(m) - \hat{\xi}(m)\right)^2 \tag{33}$$

which is linearly related to the REW parameter squared quantization error, $(\xi(m)-\hat{\xi}(m))^2$ and, therefore, justifies direct VQ of the REW parameter.

B.1. Simplified REW Parameter AbS VQ—Non Weighted Distortion

Figures 4, 6:
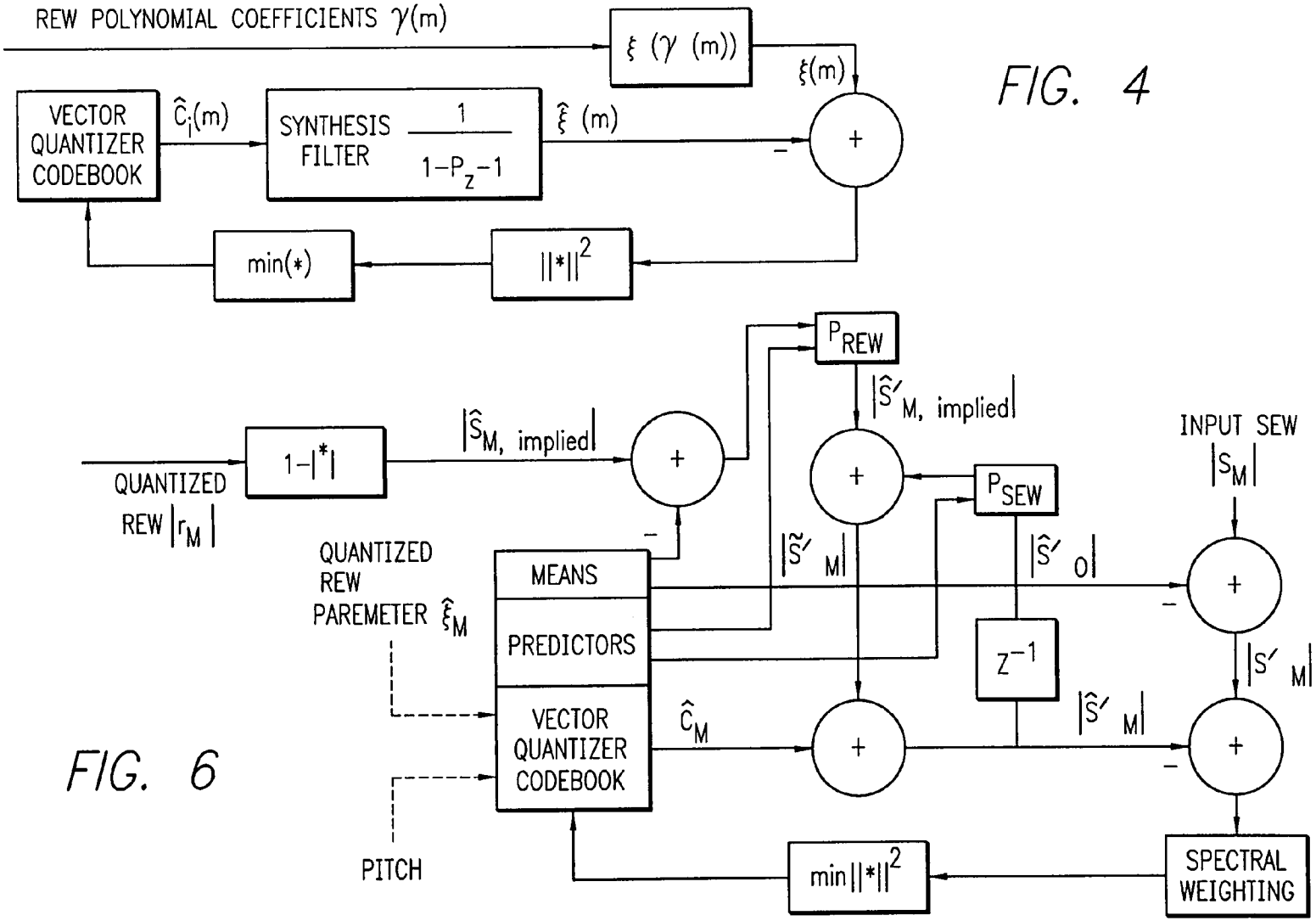
FIG. 4 is a REW Parametric Representation Simplified AbS VQ.
FIG. 6 is a block diagram of the Dual Predictive AbS SEW vector quantization.

FIG. 4 illustrates a simplified AbS VQ for the REW parametric representation. The encoder maps the REW magnitude to an unvoicing REW parameter, and then quantizes the parameter by AbS VQ. Initially, the magnitudes of the M REWs in the frame are mapped to coefficient vectors, $\{\gamma(m)\}_{m=1}^{M}$. Then, for each coefficient vector, a search is performed to find the optimal representation parameter, $\xi(\gamma)$, using equation (20), to form an M-dimensional parameter vector for the current frame, $\{\xi(\gamma(m))\}_{m=1}^{M}$. Finally, the parameter vector is encoded by AbS VQ. The decoded spectra, $\{\hat{R}(\omega,\hat{\xi}(m))\}_{m=1}^{M}$, are obtained from the quantized parameter vector, $\{\hat{\xi}(m)\}_{m=1}^{M}$, using equation (15). This scheme allows for higher temporal, as well as spectral REW resolution, compared to the common method described in W. B. Kleijn, et al, IEEE ICASSP'95, pp. 508-511 (1995), since no downsampling is performed, and the continuous parameter is vector quantized in AbS.

B.2. Simplified REW Parameter AbS VQ—Weighted Distortion

Figure 5:
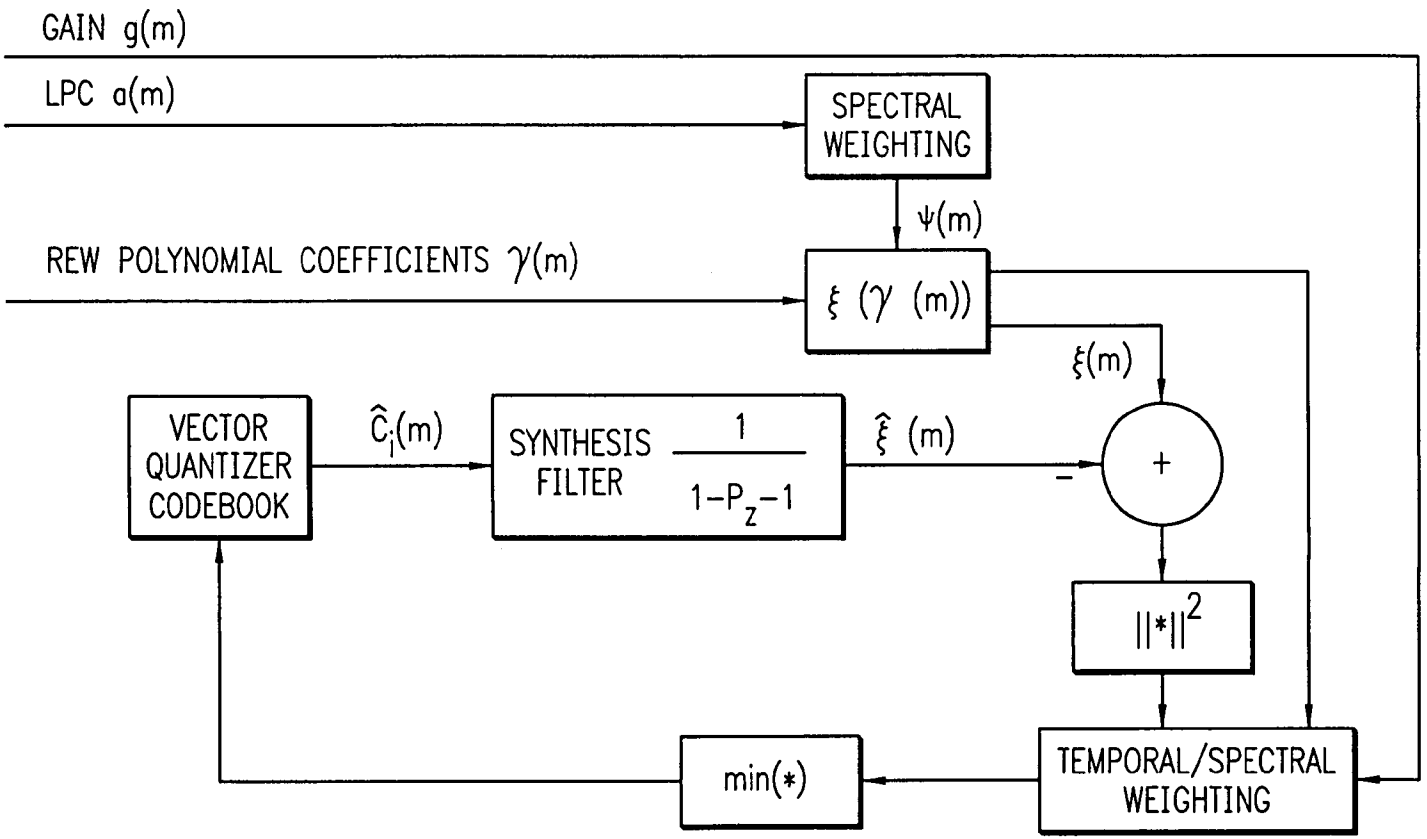
FIG. 5 is a REW Parametric Representation Simplified Weighted AbS VQ.

The simplified quantization scheme is improved to incorporate spectral and temporal weightings, as illustrated in FIG. 5. The REW parameter vector is first mapped to REW parameter by minimizing a distortion, which is weighted by the coefficient spectral weighting matrix $\Psi$, as described in section 3.D. Then, the resulted REW parameter is used to compute a weighting, $w_s(\xi(m))$, which we choose to be the spectral sensitivity to the REW parameter squared quantization error, $(\xi(m)-\hat{\xi}(m))^2$, given by:

$$w_s(\xi(m)) = \left(\frac{\partial\tilde{\gamma}}{\partial\xi}\right)^T \Psi\left(\frac{\partial\tilde{\gamma}}{\partial\xi}\right)\Big|_{\xi(m)} \tag{34}$$

For the piecewise linear representation case, using equation (33), the following equation is obtained:

$$w_s(\xi(m)) = \left(\frac{\partial\tilde{\gamma}}{\partial\xi}\right)^T \Psi\left(\frac{\partial\tilde{\gamma}}{\partial\xi}\right)\Big|_{\xi(m)} = \frac{1}{\Delta^2}\left(\tilde{\gamma}_n(\xi(m)) - \tilde{\gamma}_{n-1}(\xi(m))\right)^T \Psi(W(m))\left(\tilde{\gamma}_n(\xi(m)) - \tilde{\gamma}_{n-1}(\xi(m))\right) \tag{35}$$

The above derivative can be easily computed off line. Additionally, a temporal weighting, in form of monotonic function of the gain, denoted by $w_t(g(m))$, is used to give relatively large weight to waveforms with larger gain values. The AbS REW parameter quantization is computed by minimizing the combined spectrally and temporally weighted distortion:

$$D\left(\{\xi(m)\}_{m=1}^{M},\ \{\hat{\xi}(m)\}_{m=1}^{M}\right) = \sum_{m=1}^{M} w_t(g(m))w_s(\xi(m))\left(\xi(m) - \hat{\xi}(m)\right)^2 \tag{36}$$

The weighted distortion scheme improves the reconstructed speech quality, most notably in mixed voiced and unvoiced speech segments. This may be explained by an improvement in REW/SEW mixing.

Dual Predictive AbS SEW Quantization

FIG. 6 illustrates a Dual Predictive SEW AbS VQ scheme which uses two observables, (a) the quantized REW, and (b) the past quantized SEW, to jointly predict the current SEW. Although we refer to the operator on each observable as a "predictor", in fact both are components of a single optimized estimator. The SEW and the REW are complex random vectors, and their sum is a residual vector having elements whose magnitudes have a mean value of unity. In low bit-rate WI coding, the relation between the SEW and the REW magnitudes was approximated by computing the magnitude of one as the unity complement of the other. Suppose $|\hat{r}_M|$ denotes the spectral magnitude vector of the last quantized REW in the current frame. An "implied" SEW vector, is calculated by:

$$|\hat{S}_{M,implied}|=1-|\hat{r}_M| \tag{37}$$

and from which the mean vector is removed. Vectors whose means are removed are denoted with an apostrophe. Then, a (mean-removed) estimated "implied" SEW magnitude vector, $|\tilde{s}'_{M,implied}|$, is computed using a diagonal estimation matrix $P_{REW}$, $$|\tilde{s}_{M,implied}|=P_{REW}|\hat{s}'_{M,implied}| \tag{38}$$

Additionally, a "self-predicted" SEW vector is computed by multiplying the delayed quantized SEW vector, $|\hat{s}'_0|$, by a diagonal prediction matrix $P_{SEW}$. The predicted (mean-removed) SEW vector, $|\tilde{s}'_M|$, is given by:

$$|\tilde{s}'_M|=P_{REW}|\hat{s}'_{M,implied}|+P_{SEW}|\hat{s}'_0| \tag{39}$$

The quantized vector, $\hat{c}_M$, is determined by an AbS search according to:

$$\hat{c}_M = \underset{c_i}{\operatorname{argmin}}\{(|(s'_M| - |\tilde{s}'_M| - c_i)^T W_M(|s'_M| - |\tilde{s}'_M| - c_i)\} \tag{40}$$

where $W_M$ is the diagonal spectral weighting matrix; see O. Gottesman, (1999), *IEEE ICASSP'99*, vol. 1:269-272; O. Gottesman and A. Gersho, (1999), *IEEE Speech Coding Workshop*, pp. 90-92, Finland; O. Gottesman and A. Gersho, (1999), EUROSPEECH'99, pp. 1443-1446, Hungary. The (mean-removed) quantized SEW magnitude, $|\hat{s}'_M|$, is the sum of the predicted SEW vector, $|\tilde{s}'_M|$, and the codevector $\hat{c}_M$:

$$|\hat{s}'_M|=|\tilde{s}'_M|+\hat{c}_M \tag{41}$$

In order to exploit the information about the pitch and voicing level, the possible pitch range was partitioned into six subintervals, and the REW parameter range into three. Also, eighteen codebooks were generated, one for each pair of pitch range and unvoicing range. Each codebook has associated two mean vectors, and two diagonal prediction matrices. To improve the coder robustness and the synthesis smoothness, the cluster used for the training of each codebook overlaps with those of the codebooks for neighboring ranges. Since each quantized target vector may have a different value of the removed mean, the quantized mean is added temporarily to the filter memory after the state update, and the next quantized vector's mean is subtracted from it before filtering is performed.

Figure 7:
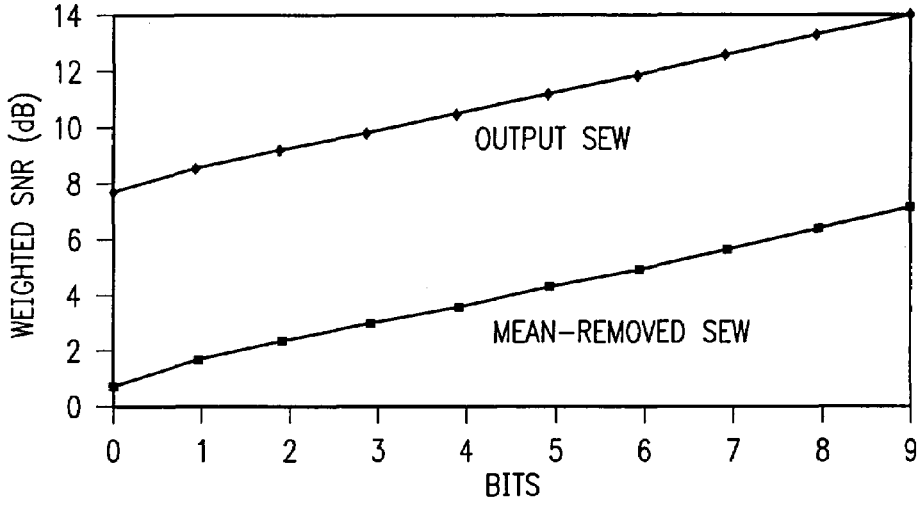
FIG. 7 is a weighted Signal-to-Noise Ratio (SNR) for Dual Predictive AbS SEW VQ.
Figure 8:
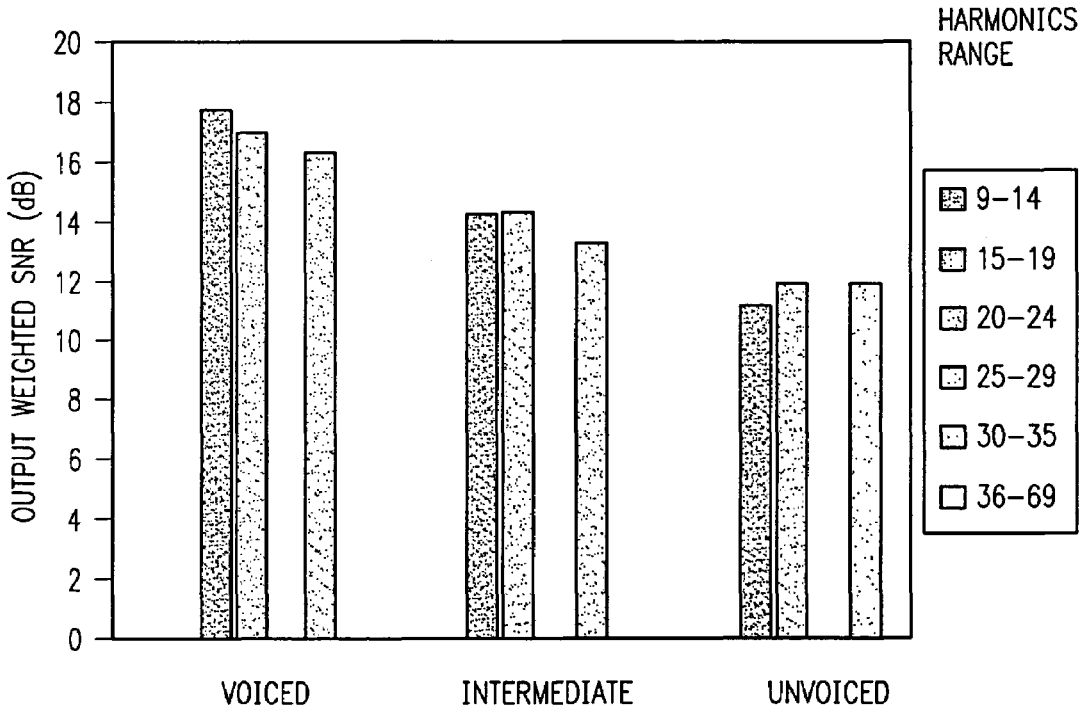
FIG. 8 is an output Weighted SNR for the 18 codebooks, 9-bit AbS SEW VQ.
Figure 9:
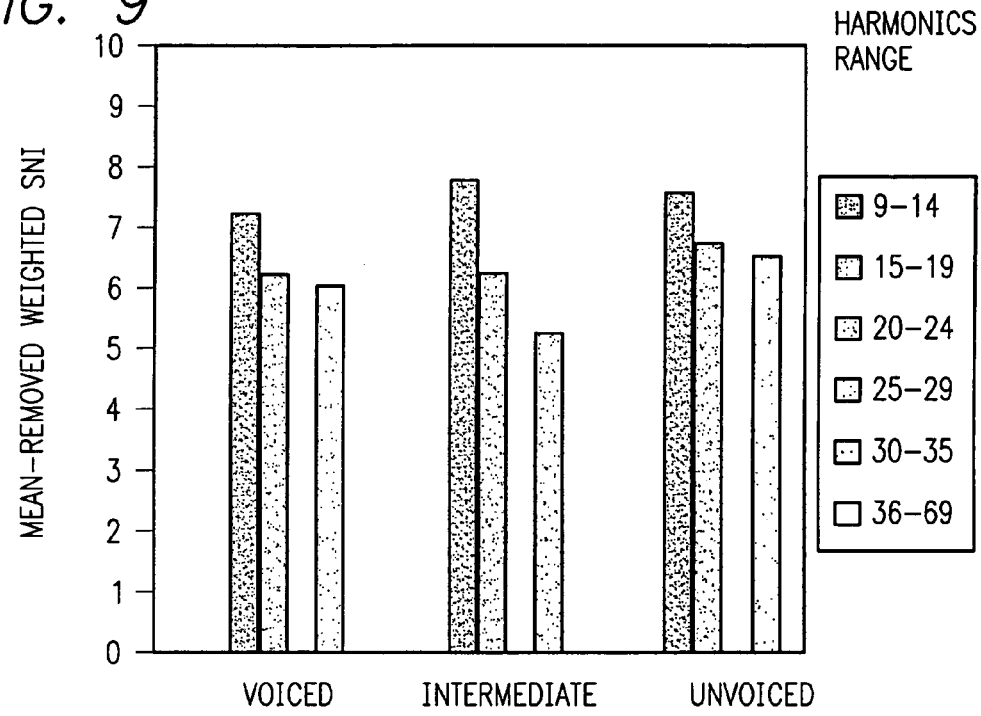
FIG. 9 is a mean-removed SEW's Weighted SNR for the 18 codebooks, 9-bit AbS SEW VQ.

The output weighted SNR, and the mean-removed weighted SNR, of the scheme are illustrated in FIG. 7. Evidently, a very high SNR is achieved with a relatively small number of bits. The weighted SNR of each codebook, for the 9-bit case, is illustrated in FIG. 8. The differences in SNR between three REW parameter ranges is dominated by the different means. The respective mean-removed weighted SNR of each codebook is illustrated in FIG. 9. Within each voicing range the differences in SNR between each pitch range are mainly due to the number of bit per vector sample, which decreases as the number of harmonics increases, and to the prediction gain.

Figure 10:
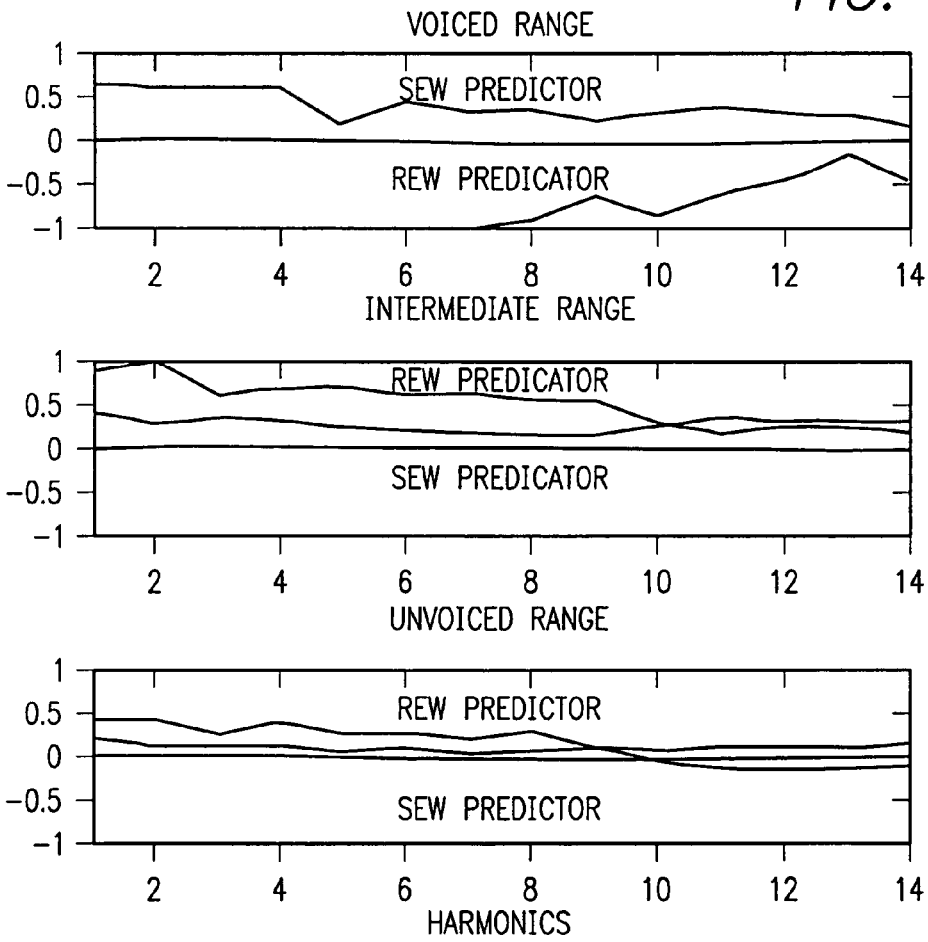
FIG. 10 are predictors for three REW parameter ranges.

Examples for the two predictors for three REW parameter ranges are illustrated in FIG. 10. For voiced segment the SEW predictor is dominant, whereas the REW predictor is less important since its input variations in this range are very small. As the voicing decreases, the SEW predictor decreases, and the REW predictor becomes more dominant at the lower part of the spectrum. Both predictors decrease as the voicing decreases from the intermediate range to the unvoiced range.

Bit Allocation

The bit allocation for the 2.8 kbps EWI coder is given in Table 1. The frame length is 20 ms, and ten waveforms are extracted per frame. The line spectral frequencies (LSFs) are coded using predictive MSVQ, having two stages of 10 bit each, a 2-bit increase compared to the past version of our code; see O. Gottesman and A. Gersho, (1999), *IEEE Speech Coding Workshop*, pp. 90-92, Finland; O. Gottesman and A. Gersho, (1999), EUROSPEECH'99, pp. 1443-1446, Hungary. The 10-th dimensional log-gain vector is quantized using 9 bit AbS VQ; The pitch is coded twice per frame. A fixed SEW phase was trained for each one of the eighteen pitch-voicing ranges; see O. Gottesman, (1999), *IEEE ICASSP'99*, vol. 1:269-272.

TABLE 1

| Parameter | Bits/Frame | Bits/second |
|---|---|---|
| LPC | 20 | 1000 |
| Pitch | 2 × 6 = 12 | 600 |
| Gain | 9 | 450 |
| SEW magnitude | 8 | 400 |
| REW magnitude | 7 | 350 |
| Total | 56 | 2800 |

Subjective Results

A subjective A/B test was conducted to compare the 2.8 kbps EWI coder of this invention to G.723.1. The test data included 24 modified intermediate reference system (M-IRS) filtered speech sentences, 12 of which are of female speakers, and 12 of male speakers; see ITU-T, (1996), "Recommendation P.830, Subjective Performance Assessment of Telephone Band and Wideband Digital Codecs", Annex D, ITU, Geneva. Twelve listeners participated in the test. The test results, listed in Table 2 and Table 3, indicate that the subjective quality of the 2.8 kbps EWI exceeds that of G.723.1 at 5.3 kbps, and it is slightly better than that of G.723.1 at 6.3 kbps. The EWI preference is higher for male than for female speakers.

TABLE 2

| Test | 2.8 kbps WI | 5.3 kbps G.723.1 | No Preference |
|---|---|---|---|
| Female | 40.28% | 33.33% | 26.39% |
| Male | 48.61% | 24.31% | 27.08% |
| Total | 44.44% | 28.82% | 26.74% |

Table 2 shows the results of subjective A/B test for comparison between the 2.8 kbps EWI coder to 5.3 kbps G.723.1. With 95% certainty the result lies within +/−5.53%.

TABLE 3

| Test | 2.8 kbps WI | 6.3 kbps G.723.1 | No Preference |
|---|---|---|---|
| Female | 38.19% | 36.81% | 25.00% |
| Male | 43.06% | 31.94% | 25.00% |
| Total | 40.63% | 34.38% | 25.00% |

Table 3 shows the results of subjective A/B test for comparison between the 2.8 kbps EWI coder to 6.3 kbps G.723.1. With 95% certainty the result lies within +/−5.59%.

It should, of course, be noted that while the present invention has been described in terms of an illustrative embodiment, other arrangements will be apparent to those of ordinary skills in the art. For example;

While in the disclosed embodiment in FIG. 3 have described auto-regressive (AR) synthesis filter, in other arrangements moving-average (MA) filter may be used.

While in the disclosed embodiment was related to waveform interpolative speech coding, in other arrangements it may be used in other coding schemes.

While in the disclosed embodiment temporal weighting, and/or spectral weighting are described, they are optional, and in other arrangements any or both of them may not be used.

While in the disclosed embodiment switch prediction having two predictors is described, in other arrangements no switch, or more than two predictor choice may be used.

While in the disclosed embodiment illustrated in FIG. 6 mean vectors are subtracted from the vector, this may be viewed as optional, and in other arrangements any or all of such mean vectors may not be used.

While in the disclosed embodiment the pitch range and/or the voicing parameter values were partitioned into subranges, and codebooks were used for each subrange, this may be viewed as optional, and in other arrangements any or all of such subranges may not be used, or other number or type of subranges may be used.

While in the disclosed embodiment describes prediction matrices were diagonal, in other arrangements non diagonal prediction matrices may be used.

The following references are each incorporated herein by reference:

B. S. Atal, and M. R. Schroeder, "Stochastic Coding of Speech at Very Low Bit Rate", *Proc. Int. Conf. Comm, Amsterdam*, pp. 1610-1613, 1984; I. S. Burnett, and D. H. Pham, "Multi-Prototype Waveform Coding using Frame-by-Frame Analysis-by-Synthesis", *IEEE ICASSP'97*, pp. 1567-1570, 1997; I. S. Burnett, and G. J. Bradley, "New Techniques for Multi-Prototype Waveform Coding at 2.84 kb/s", *IEEE ICASSP'95*, pp. 261-263, 1995; I. S. Burnett, and G. J. Bradley, "Low Complexity Decomposition and Coding of Prototype Waveforms", *IEEE Workshop on Speech Coding for Telecommunications*, pp. 23-24, 1995; I. S. Burnett, and R. J. Holbeche, "A Mixed Prototype Waveform/Celp Coder for Sub 3 kb/s", *IEEE ICASSP'93*, Vol. II, pp. 175-178, 1993; O. Gottesman, "Enhanced Waveform Interpolative Coder", Patent Cooperation Treaty—International Application—Request, U.S. Ser. No. 60/110,522 and 60/110,641, UC Case No.: 98-312-3, 2000; O. Gottesman, "Dispersion Phase Vector Quantization for Enhancement of Waveform Interpolative Coder", *IEEE ICASSP'99*, vol. 1, pp. 269-272, 1999; O. Gottesman and A. Gersho, "Enhanced Analysis-by-Synthesis Waveform Interpolative Coding at 4 kbps", EUROSPEECH'99, pp. 1443-1446, 1999, Hungary; O. Gottesman and A. Gersho, "Enhanced Waveform Interpolative Coding at 4 kbps", *IEEE Speech Coding Workshop*, pp. 90-92, 1999, Finland; O. Gottesman and A. Gersho, "High Quality Enhanced Waveform Interpolative Coding at 2.8 kbps", submitted to *IEEE ICASSP'2000*, Istanbul, Turkey, June 2000; D. Griffin, and J. S. Lim, "Multiband Excitation Vocoder", *IEEE Trans. ASSP, Vol.* 36, No. 8, pp. 1223-1235, August 1988; ITU-T, "Recommendation P.830, Subjective Performance Assessment of Telephone Band and Wideband Digital Codecs", Annex D, ITU, Geneva, February 1996; W. B. Kleijn, Y. Shoham, D. Sen, and R. Haagen, "A Low-Complexity Waveform Interpolation Coder", *IEEE ICASSP'96*, pp. 212-215, 1996; W. B. Kleijn, and J. Haagen, "A Speech Coder Based on Decomposition of Characteristic Waveforms", *IEEE ICASSP'95*, pp. 508-511, 1995; W. B. Kleijn, and J. Haagen, "Waveform Interpolation for Coding and Synthesis", in *Speech Coding Synthesis* by W B. Kleijn and K. K. Paliwal, Elsevier Science B. V., Chapter 5, pp. 175-207, 1995; W. B. Kleijn, and J. Haagen, "Transformation and Decomposition of The Speech Signal for Coding", *IEEE Signal Processing Letters*, Vol. 1, No. 9, pp. 136-138, 1994; W. B. Kleijn, "Encoding Speech Using Prototype Waveforms", *IEEE Trans. Speech and Audio Processing*, Vol. 1, No. 4, pp. 386-399, October 1993; W. B. Kleijn, "Continuous Representations in Linear Predictive Coding", *IEEE ICASSP'91*, pp. 201-203, 1991; R. J. McAulay, and T. F. Quatieri, "Sinusoidal Coding", in *Speech Coding Synthesis* by W B. Kleijn and K. K. Paliwal, Elsevier Science B. V., Chapter 4, pp. 121-173, 1995; Y. Shoham, "Very Low Complexity Interpolative Speech Coding at 1.2 to 2.4 kbps", *IEEE ICASSP'97*, pp. 1599-1602, 1997; Y. Shoham, "Low-Complexity Speech Coding at 1.2 to 2.4 kbps Based on Waveform Interpolation", *International Journal of Speech Technology*, Kluwer Academic Publishers, pp. 329-341, May 1999; and Y. Shoham, "High Quality Speech Coding at 2.4 to 4.0 kbps Based on Time-Frequency-Interpolation", *IEEE ICASSP'93*, Vol. II, pp. 167-170, 1993.

The invention claimed is:

1. A computerized system for coding a digital input signal representative of an audio waveform, comprising:

a vector quantizer module comprising an input accepting a vector or rapidly evolving waveform spectra determined form the digital input signal;

a computer readable codebook comprising a plurality of arrays of quantized parametric vectors;

computer readable program instructions for searching said parameter codebook for one of said plurality of arrays of quantized parametric vectors which minimizes distortion; and computer program instructions for outputting a computer readable indicator that points to the one of said plurality of arrays of quantized parameter vectors which minimizes distortion.

2. The system of claim 1 wherein the indicator determines a quantized vector of the rapidly evolving waveform.

3. The system of claim 2 further comprising a slowly evolving waveform vector quantizer, said slowly evolving waveform quantizer in communication with the vector quantizer for inputting the quantized vector of the rapidly evolving waveform, said slowly evolving waveform quantizer comprising instructions for determining an implied slowly evolving waveform as a function of the quantized rapidly evolving waveform.

4. The system of claim 1 further comprising a synthesis filter coupled to the output of the codebook wherein said synthesis filter outputs a synthesized parameter vector.

5. The system of claim 1 further comprising computer readable instructions for spectrally weighting a plurality of coefficient vectors mapped from synthesized parameter vectors.

6. The system of claim 1 wherein the audio waveform comprises speech.

7. The system of claim 6, wherein said speech comprises mixed voiced and unvoiced speech segments.

8. The system of claim 1 further comprising a converter that samples an analog input signal to create the digital input signal.

9. The system of claim 1, wherein the system outputs a coded representation of the digital input signal and the computer readable indicator is embedded in that coded representation.

10. A computer implemented method for coding a digital input signal representative of an audio waveform, comprising:

determining a vector of rapidly evolving waveform spectra from the digital input signal;

searching a computer readable codebook comprising a plurality of arrays of quantized parametric vector for one of said plurality of arrays of quantized parameter vectors which minimizes distortion; and outputting a computer readable indicator that points to the one of said plurality of arrays of quantized parameter vectors which minimizes said distortion.

11. The method of claim 10 wherein the indicator determines a quantized vector of the rapidly evolving waveform.

12. The method of claim 10 further comprising synthesis filtering the output of the codebook and outputting a synthesized parameter vector.

13. The method of claim 10 further comprising spectrally weighting a plurality of coefficient vectors mapped from synthesized parameter vectors.

14. The method of claim 10 further comprising determining an implied slowly evolving waveform as a function of the quantized rapidly evolving waveform.

15. The method of claim 10 wherein the digital input signal comprises speech.

16. The method of claim 15, wherein said speech comprises mixed voiced and unvoiced speech segments.

17. The method of claim 10 further comprising sampling an analog input signal to create said digital input signal.

18. The method of claim 10, wherein the method outputs a coded representation of the digital input signal and the computer readable indicator is embedded in that coded representation.

* * * * *

UNITED STATES PATENT AND TRADEMARK OFFICE

CERTIFICATE OF CORRECTION

PATENT NO. : 7,584,095 B2
APPLICATION NO. : 11/234631
DATED : September 1, 2009
INVENTOR(S) : Gottesman et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 124 days.

Signed and Sealed this

Fourteenth Day of September, 2010

David J. Kappos

David J. Kappos
*Director of the United States Patent and Trademark Office*